US006099139A

United States Patent [19]

Lapensee

[11] Patent Number: 6,099,139

[45] Date of Patent: Aug. 8, 2000

[54] LANDSCAPE LIGHTING

[76] Inventor: Martin Eric Lapensee, 178 Homestead Crescent NW., Edmonton, Alberta, Canada, T5A 2Y4

[21] Appl. No.: 09/067,444

[22] Filed: Apr. 28, 1998

[30] Foreign Application Priority Data

Mar. 25, 1998 [CA] Canada ..... 2223109

[51] Int. Cl.[7] ..... F21S 1/00; A63B 69/36

[52] U.S. Cl. ..... 362/153.1; 286/386; 286/285; 286/286; 473/150; 473/169

[58] Field of Search ..... 362/153.1, 286, 362/386, 285, 431; 473/409, 150, 169

[56] References Cited

U.S. PATENT DOCUMENTS 4,180,850 12/1979 Bivens ..... 362/285
5,003,441 3/1991 Crowe et al. .
5,072,345 12/1991 Goggia ..... 362/153.1
5,075,834 12/1991 Puglisi ..... 362/386
5,142,463 8/1992 Panagotacos et al. ..... 362/285
5,265,875 11/1993 Fitzgerald ..... 362/431
5,398,026 3/1995 Handsaker ..... 362/286
5,445,373 8/1995 Franks .
5,572,837 11/1996 Featherstone et al. ..... 362/385

*Primary Examiner*—Thomas M. Sember
*Attorney, Agent, or Firm*—Davis and Bujold

[57] ABSTRACT

Landscape lighting includes a shaft excavated in a ground surface. A telescopic pole assembly, which is movable between a telescopically extended position and a retracted position, is anchored within the shaft. The entire telescopic pole assembly is concealed within the shaft when in the retracted position. When in the telescopically extended position, the telescopic pole assembly extends out of the shaft and high into the air to illuminate the surrounding area. The landscape lighting is suited for illuminating golf courses in order that golf may be played at night.

5 Claims, 5 Drawing Sheets

LANDSCAPE LIGHTING

FIELD OF THE INVENTION

The present invention relates to landscape lighting and, in particular, landscape lighting suitable for illuminating a golf course.

BACKGROUND OF THE INVENTION

U.S. Pat. No. 5,445,373 describes an invention by Randy Franks entitled "Night Golf System". This patent , which issued to Night Golf, Inc. in 1995, describes an approach to making it possible to play golf twenty-four hours a day on golf courses. The teachings of the patent are to use a glow in the dark ball in combination with a light stick carried by the golfer and together with lights strategically positioned on the course.

The Night Golf, Inc. patent provides a description of the prior art. Golf courses have been illuminated using lights mounted on poles or trees surrounding the course. The Night Golf, Inc. patent indicates that these lights have been considered as an unacceptable solution. They detracted from the aesthetic beauty of the golf course during the day, which was considered to be a significant factors in the golfers overall enjoyment of the golf course. They create an additional obstruction on the golf course during daytime play. They increased golf course maintenance costs as the lamps and light fixtures were exposed to year round weather conditions. To service the lamps and light fixtures positioned high above the ground, was considered very time consuming and potentially dangerous. Maintenance personnel had to travel to each light location, position a ladder underneath the light and then climb up the ladder to the light fixture to replace the lamp bulb.

SUMMARY OF THE INVENTION

What is required is an alternative form of landscape lighting that addresses the problems experienced in lighting golf courses in the past.

According to the present invention there is provided landscape lighting which includes a shaft excavated in a ground surface. The shaft has an upper access opening. A plurality of telescopically connected tubular sections are provided which form a telescopic pole assembly. A base section is provided at a first end of the telescopic pole assembly and a lamp support section at a second end of the telescopic pole assembly. At least one intermediate section is disposed between the base section and the lamp support section. The telescopic pole assembly is movable between a telescopically extended position and a retracted position. The base section is anchored within the shaft. The entire telescopic pole assembly fits within the shaft when in the retracted position. The at least one intermediate section and the lamp support section rises out of the shaft when in the telescopically extended position. A light fixture is mounted to the lamp support section. Means is provided for moving the telescopic pole assembly from the retracted position to the telescopically extended position.

The landscape lighting, as described above, is believed to address the problems in the prior art. The lighting remains concealed in its retracted position during daylight hours. It does not adversely affect the aesthetic appearance of the golf course, nor does it present an obstacle on the course that could interfere with the flight of the golf ball. When required for use at night, the landscape lighting can be moved to an extended position where the light fixture is positioned at a considerable height above the fairway of golf course, thereby providing illumination necessary for the use and enjoyment of the golf course. The landscape lighting is protected from weather damage when in the retracted position and can be serviced, as required, in the retracted position.

The safety of golfers is always a matter of paramount concern. In order to ensure that a golfer does not fall into the shaft, it should be kept covered. It would be extremely labour intensive to cover all shafts manually every time the landscape lighting was moved from the retracted position to the extended position. It is, therefore, preferred that means be provided to cover the access opening to the shaft automatically upon movement of the telescopic pole assembly. Even more beneficial results may, therefore be obtained when an upper access opening cover is mounted to a remote end of the lamp support section above the light fixture. The upper access opening cover serves as a closure for the access opening when the telescopic pole assembly is in the retracted position. Similarly, even more beneficial results may be obtained when a lower access opening cover is mounted to the at least one intermediate section, and internal stop means are provided around a periphery of the access opening. The lower access opening cover is raised by the at least one intermediate section to engage the internal stop means, thereby serving as a closure for the access opening when the telescopic pole assembly is in the telescopically extended position. It is preferred that the lower access opening cover have a maintenance access hatch.

It is preferred that the shaft have a lower portion just large enough to receive the base section of the telescopic pole assembly and an enlarged upper portion. The upper portion conceals the light fixture and all electrical equipment. Where ground water presents a potential problem a sump pump is disposed within the upper portion of the shaft as a means of ground water control.

The preferred means for moving the telescopic pole assembly from the retracted position to the telescopically extended position includes cable linkages between the telescopically connected tubular sections and a winch coupled to at least one of the cable linkages. The winch draws in and feeds out cable as required to effect movement of the telescopic pole assembly through the cable linkages. The preferred cable linkages include a drive cable linkage having a first end connected to the winch and a second end to a bottom end of the intermediate section. Upon the first cable linkage being drawn in by the winch, the intermediate section is telescopically extended from the base section. A coupling cable linkage is also provided which as a first end anchored to a bottom of the base section and a second end anchored to a bottom of the lamp supporting section. The coupling cable linkage passes over direction altering means, such as a sheave, positioned at an upper end of the at least one intermediate section. A telescopic movement extending the intermediate section moves the sheave from the base section where the first end of the coupling cable linkage is anchored. This draws the lamp supporting section to the telescopically extended position.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
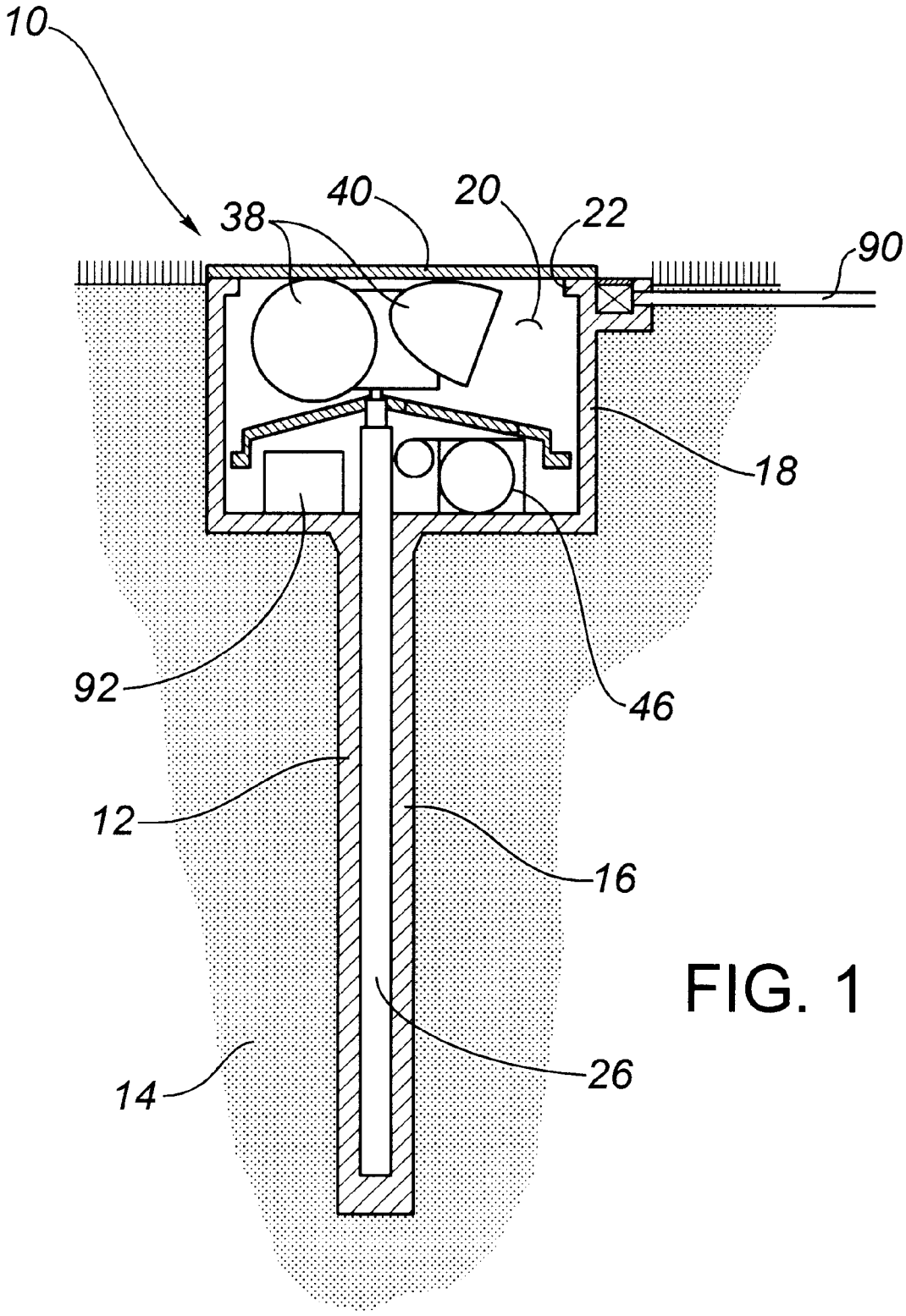
FIG. 1 is a side elevation view in section of the landscape lighting constructed in accordance with the teachings of the present invention in a retracted position.

The preferred embodiment, landscape lighting generally identified by reference numeral 10, will now be described with reference to FIGS. 1 through 5.

Figure 2:
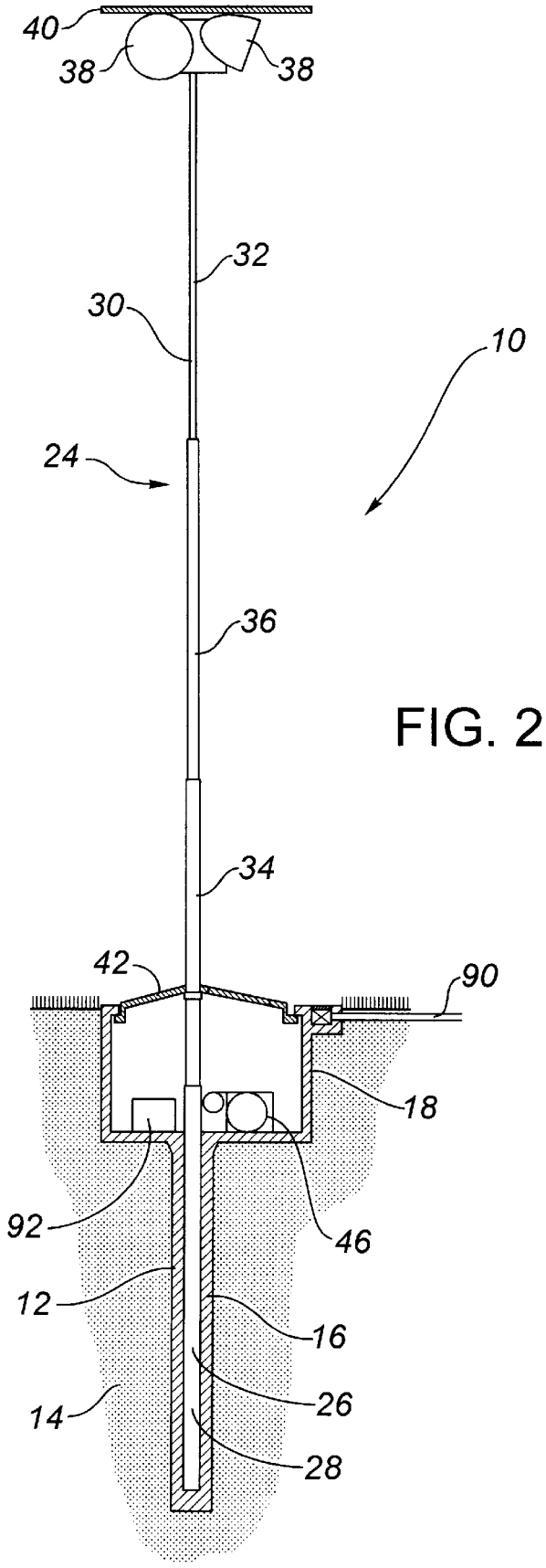
FIG. 2 is a side elevation view in section of the landscape lighting illustrated in FIG. 1 in a telescopically extended position.
Figure 3:
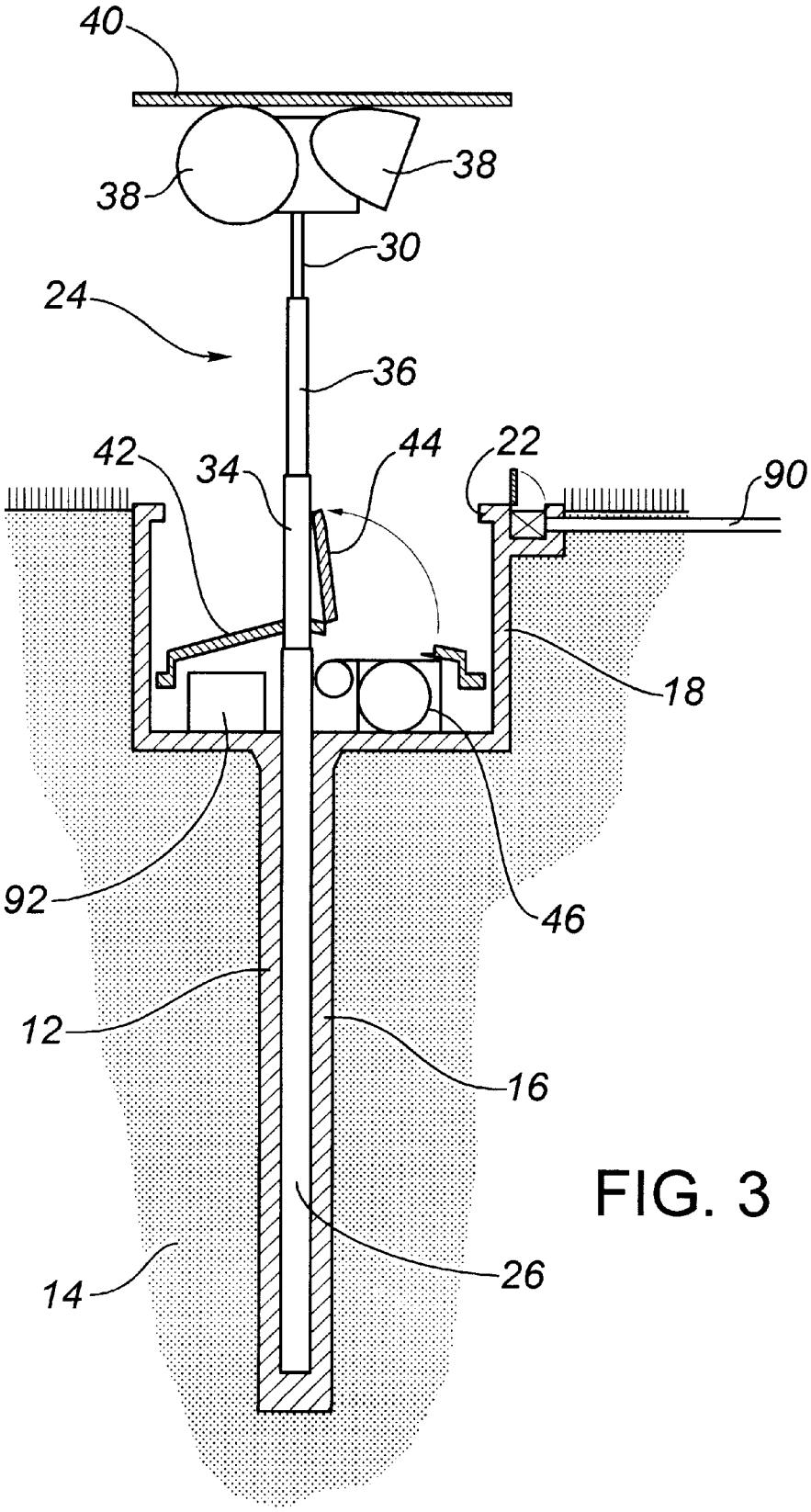
FIG. 3 is a side elevation view in section of the landscape lighting illustrated in FIG. 1 in an intermediate servicing position.
Figure 4:
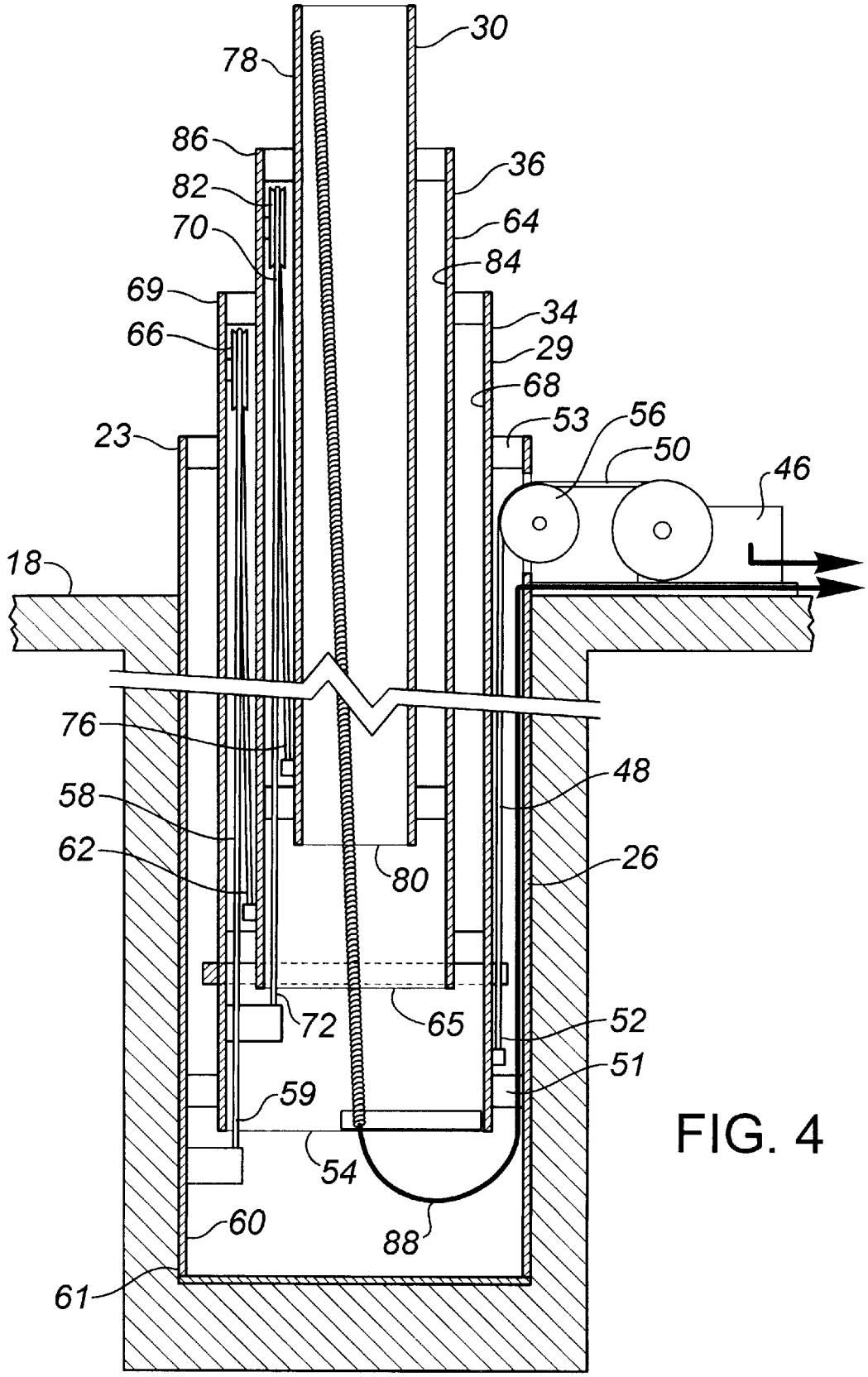
FIG. 4 is a detailed side elevation view in section of the landscape lighting illustrated in FIG. 1 in a retracted position.

Referring to FIG. 1, landscape lighting 10 includes a shaft 12 excavated in a ground surface 14. Shaft 12 has a lower portion 16 and an upper portion 18 that is wider than lower portion 16. Shaft 12 has an upper access opening 20 with an inwardly directed peripheral flange 22. Referring to FIG. 2, a plurality of telescopically connected tubular sections are provided which form a telescopic pole assembly, generally identified by reference numeral 24. The tubular sections of telescopic pole assembly 24 include a base section 26 at a first end 28 of the telescopic pole assembly 24 and a lamp support section 30 at a second end 32 of telescopic pole assembly 24. Several intermediate sections (two are illustrated a first intermediate section 34 and a second intermediate section 36) are disposed between base section 26 and lamp support section 30. Telescopic pole assembly is movable between a telescopically extended position, as illustrated in FIG. 2, and a retracted position, as illustrated in FIG. 1. Referring to FIG. 1, base section 26 is anchored within lower portion 16 of shaft 12. Lower portion 16 of shaft 12 is preferably, just large enough to accommodate base section 26. Referring to FIG. 1, lamp support section 30 of telescopic pole assembly 24 fits within upper portion 18 of shaft 12 when in the retracted position. Referring to FIG. 2, intermediate sections 34, 36 and lamp support section 30 extend out of shaft 12 when in the telescopically extended position. Referring to FIG. 2, a light fixture 38 is mounted to lamp support section 30. Referring to FIG. 1, light fixture 38 is concealed within upper portion 18 of shaft 12 when telescopic pole assembly 24 is in the retracted position. An upper access opening cover 40 is mounted above light fixture 38. Upper access opening cover 40 serves as a closure for access opening 20 to shaft 12 when telescopic pole assembly 24 is in the retracted position. Referring to FIG. 2, a lower access opening cover 42 is mounted to first intermediate section 34. Lower access opening cover 42 is raised by first intermediate section 34 until it engages inwardly directed peripheral flange 22 on access opening 20. Lower access opening cover 42 serves as a closure for access opening 20 when telescopic pole assembly 24 is in the telescopically extended position. Referring to FIG. 3, telescopic pole assembly 24 can be moved to an intermediate position for servicing. In this intermediate position, light fixture 38 can be easily serviced without the need of a ladder. Lower access opening cover 42 has a maintenance access hatch 44 to allow access to upper portion 18 of shaft 12. It is preferred that maintenance access hatch 44 have a key lock (not shown). Referring to FIG. 4, telescopic pole assembly 24 is moved from the retracted position to the telescopically extended position by a winch 46 and a plurality of cable linkages, as will hereinafter be further described. Winch 46 is an electric winch that is positioned within enlarged upper portion 18 of shaft 12. A drive cable linkage 48 has a first end 50 connected to winch 46 and a second end 52 connected to a bottom end 54 of an exterior surface 29 of first intermediate section 34. Drive cable linkage 48 passes over a sheave 56. Upon drive cable linkage 48 being drawn in by winch 46, first intermediate section 34 is telescopically extended from base section 26. Intermediate section 34 is guided in this movement by a set of lower skid plate 51 and a set of upper skid plates 53. Although skid plates are illustrated and described, rollers would work easily well to guide movement and reduce sliding friction. First set of lower skid plates 51 is attached to outer surface 29 at lower end 54 of intermediate section 34. Lower skid plates 51 slide against an interior 60 of base section 26. Upper skid plates 53 are attached to interior 60 at upper end 23 of base section 26. Upper skid plates 53 slide against exterior face 29 of intermediate section 34. Each of the telescopic sections has like lower skid plates and upper skid plates. A first coupling cable linkage 58 has a first end 59 anchored to the interior 60 of base section 26 adjacent a bottom 61 and a second end 62 anchored to an exterior 64 of second intermediate section 36 adjacent a bottom 65. First coupling cable linkage 58 passes over a first sheave 66 positioned at a interior 68 of first intermediate section 34 adjacent an upper end 69. As first intermediate section 34 is telescopically extended by winch 46 exerting a force upon drive linkage 48, first sheave 66 which is attached to first intermediate section 34 moves away from base section 26 where first end 59 of first coupling cable linkage 58 is anchored. This serves to draw second intermediate section 36 to the telescopically extended position. A second coupling cable linkage 70 has a first end 72 anchored to interior 68 of first intermediate section 34 adjacent a bottom 54 and a second end 76 anchored to an exterior 78 of lamp support section 30 adjacent a bottom 80. Second coupling cable linkage 70 passes over a second sheave 82 positioned on an interior surface 84 at an upper end 86 of second intermediate section 36. As second intermediate section 36 is telescopically extended, second sheave 82 is moved away from first intermediate section 34 where first end 72 of second coupling cable linkage 70 is anchored. This draws lamp supporting section to the telescopically extended position. The electricity necessary to provide power to light fixture 38 is provided by a power cable 88. Power cable 88 extends through lamp support section 30 and must be long enough to extend the full height of telescopic pole assembly 24 when in the fully extended position. Referring to FIGS. 1 through 3, power is provided to shaft 12 to connect to power cable 88 and electric winch 46, by an underground cable 90. Where ground water presents a potential problem, a sump pump 92 may be positioned within upper portion 18 of shaft 12.

Figure 5:
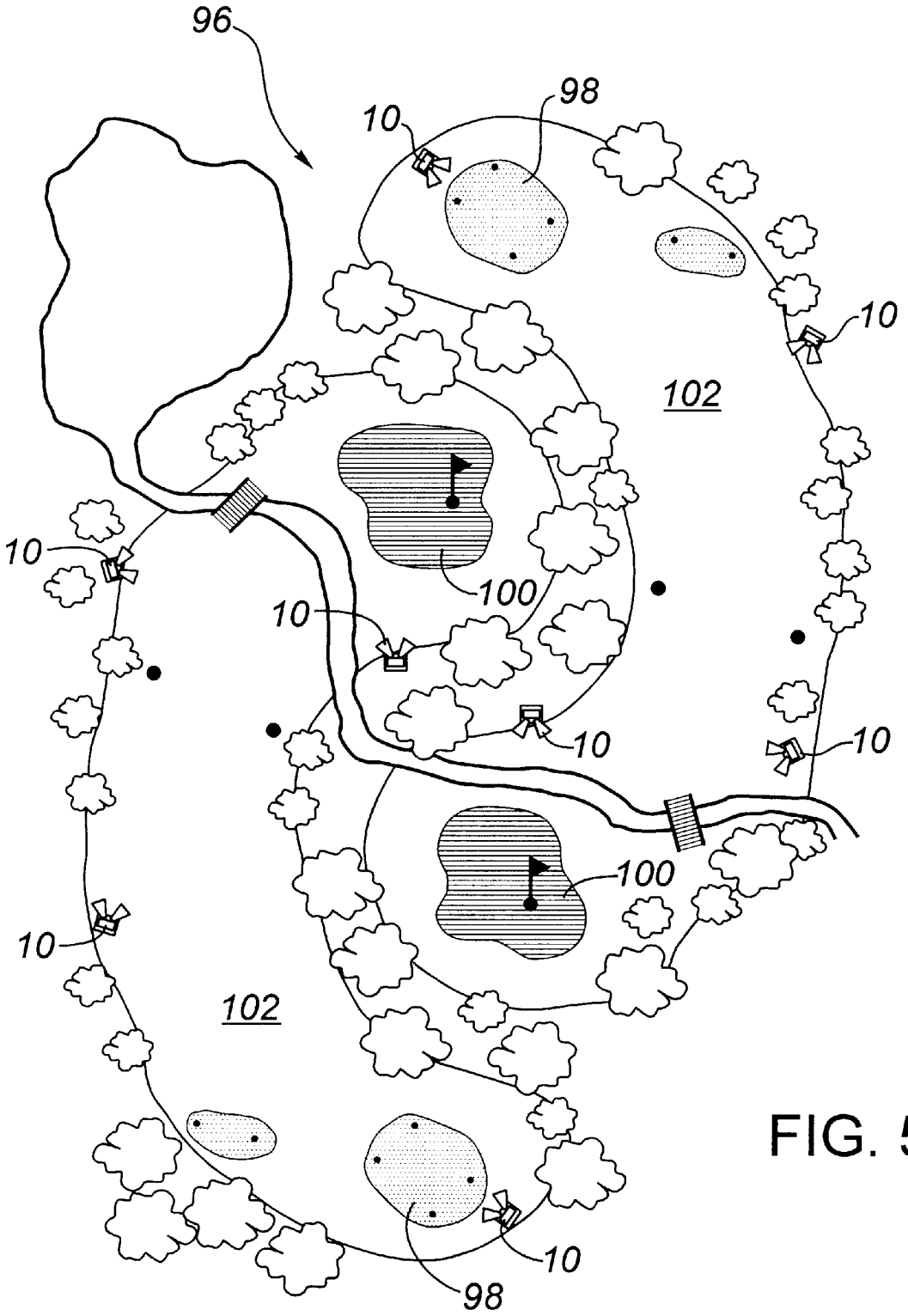
FIG. 5 is a top plan view of a golf course having the landscape lighting illustrated in FIG. 1.

The use and operation of landscape lighting 10 will now be described with reference to FIGS. 1 through 5. Referring to FIG. 1, during daylight hours telescopic pole assembly remains concealed within shaft 12. In this retracted position, light fixture 38 is shielded from weather damage. In this retracted position, landscape lighting 10 does not adversely affect the aesthetics of the golf course, nor does it act as an obstacle to the flight of golf balls. To illuminate the golf course for night play, landscape lighting 10 is moved from the retracted positioned illustrated in FIG. 1 to the telescopically extended position illustrated in FIG. 2. Referring to FIG. 4, movement from the retracted position to the telescopically extended position is effected by activating winch 46 to draw in first cable linkage 48. Upon first cable linkage 48 being drawn in by winch 46, first intermediate section 34 is telescopically extended from base section 26. As first intermediate section 34 is telescopically extended, first sheave 66 which is attached to first intermediate section 34 moves away from base section 26 where first end 59 of first coupling cable linkage 58 is anchored. This serves to draw second intermediate section 36 to the telescopically extended position. As second intermediate section 36 is telescopically extended, second sheave 82 is moved away from first intermediate section 34 where first end 72 of second coupling cable linkage 70 is anchored. This draws lamp supporting section to the telescopically extended position. Referring to FIG. 5, landscape lighting installations 10 are strategically positioned around the layout of golf course 96. The number of landscape lights 10 required will vary depending upon the length and topography of the golf hole. It is contemplated that each of landscape lights 10 will have two or more light fixtures 38. With the illumination provided by such a configuration, most golf holes will require four of landscape lights 10. One of landscape lights 10 will be positioned to illuminate a tee box area 98 for each golf hole. One of landscape lights 10 will be positioned to illuminate a green 100 for each golf hole. Two further landscape lights will be positioned to illuminate a fairway 102 for each golf hole.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. Landscape lighting comprising:

a shaft excavated in a around surface, the shaft having a ground level access opening;

a plurality of telescopically connected tubular sections forming a telescopic pole assembly including a base section at a first end of the telescopic pole assembly, a lamp support section at a second end of the telescopic pole assembly and at least one intermediate section disposed between the base section and the lamp support section, the telescopic pole assembly being movable between a telescopically extended position and a retracted position, the base section being anchored within the shaft, the entire telescopic pole assembly fitting within the shaft when in the retracted position, the at least one intermediate section and the lamp support section rising out of the shaft when in the telescopically extended position;

a light fixture mounted to the lamp support section;

means for moving the telescopic pole assembly from the retracted position to the telescopically extended position;

a first access opening cover being mounted to a remote end of the lamp support section above the light fixture, such that the first access opening cover serves as a ground level closure for the access opening when the telescopic pole assembly is in the retracted position; and a second access opening cover being mounted to the at least one intermediate section, and internal stop means are provided around a periphery of the access opening, such that the second access opening cover is raised by the at least one intermediate section to engage the internal stop means, thereby serving as a ground level closure for the access opening when the telescopic pole assembly is in the telescopically extended position, and the second access opening cover having a maintenance access hatch.

2. Landscape lighting comprising:

a shaft excavated in a around surface, the shaft having a ground level access opening;

a plurality of telescopically connected tubular sections forming a telescopic pole assembly including a base section at a first end of the telescopic pole assembly, a lamp support section at a second end of the telescopic pole assembly and at least one intermediate section disposed between the base section and the lamp support section, the telescopic pole assembly being movable between a telescopically extended position and a retracted position, the base section being anchored within the shaft, the entire telescopic pole assembly fitting within the shaft when in the retracted position, the at least one intermediate section and the lamp support section rising out of the shaft when in the telescopically extended position;

a light fixture mounted to the lamp support section;

means for moving the telescopic pole assembly from the retracted position to the telescopically extended position;

a first access opening cover being mounted to a remote end of the lamp support section above the light fixture, such that the first access opening cover serves as a around level closure for the access opening when the telescopic pole assembly is in the retracted position;

a second access opening cover being mounted to the at least one intermediate section, and internal stop means are provided around a periphery of the access opening, such that the second access opening cover is raised by the at least one intermediate section to engage the internal stop means, thereby serving as a around level closure for the access opening when the telescopic pole assembly is in the telescopically extended position, and a sump pump disposed within the upper portion of the shaft for ground water control.

3. Landscape lighting comprising:

a shaft excavated in a Around surface, the shaft having a around level access opening;

a plurality of telescopically connected tubular sections forming a telescopic pole assembly including a base section at a first end of the telescopic pole assembly, a lamp support section at a second end of the telescopic pole assembly and at least one intermediate section disposed between the base section and the lamp support section, the telescopic pole assembly being moveable between a telescopically extended position and a retracted position, the base section being anchored within the shaft, the entire telescopic pole assembly fitting within the shaft when in the retracted position, the at least one intermediate section and the lamp support section rising out of the shaft when in the telescopically extended position;

a light fixture mounted to the lamp support section;

means for moving the telescopic pole assembly from the retracted position to the telescopically extended position;

a first access opening cover being mounted to a remote end of the lamp support section above the light fixture, such that the first access opening cover serves as a ground level closure for the access opening when the telescopic pole assembly is in the retracted position;

a second access opening cover being mounted to the at least one intermediate section, and internal stop means are provided around a periphery of the access opening, such that the second access opening cover is raised by the at least one intermediate section to engage the internal stop means, thereby serving as a ground level closure for the access opening when the telescopic pole assembly is in the telescopically extended position;

the means for moving the telescopic pole assembly from the retracted position to the telescopically extended position includes several cable linkages between the telescopically connected tubular sections and a winch coupled to at least one of the several cable linkages, the winch drawing in and feeding out cable as required to effect movement of the several cable linkages, and the several cable linkages including:

a drive cable linkage having a first end connected to the winch and a second end to a bottom end of a first intermediate section, such that upon the drive cable linkage being drawn in by the winch, the first intermediate section is telescopically extended from the base section; and a first coupling cable linkage having a first end anchored to a bottom of the base section, a second end anchored to a bottom of one of a second intermediate section and the lamp supporting section, the first coupling cable linkage passing over direction altering means positioned at an upper end of the first intermediate section, such that a telescopic movement extending the first intermediate section moves the direction altering means away from the first end of the first coupling cable linkage, thereby drawing one of the second intermediate section and the lamp supporting section to the telescopically extended position.

4. Landscape lighting comprising:

a shaft excavated in a ground surface, the shaft having a lower portion, an upper portion that is larger than the lower portion, and a ground level access opening with an inwardly directed peripheral flange;

a plurality of telescopically connected tubular sections forming a telescopic pole assembly including a base section at a first end of the telescopic pole assembly, a lamp support section at a second end of the telescopic pole assembly, several intermediate sections disposed between the base section and the lamp support section, the telescopic pole assembly being movable between a telescopically extended position and a retracted position, the base section being anchored within the lower portion of the shaft, the entire telescopic pole assembly fitting within the shaft when in the retracted position, with the several intermediate sections and the lamp support section rising out of the shaft when in the telescopically extended position;

a light fixture mounted to the lamp support section and being concealed within the upper portion of the shaft when the telescopic pole assembly is in the retracted position;

a first access opening cover being mounted to a remote end of the lamp support section above the light fixture, such that the first access opening cover serves as a around level closure for the access opening to the shaft when the telescopic pole assembly is in the retracted position;

a second access opening cover being mounted to one of the several intermediate section, such that the second access opening cover is raised by one of the several intermediate sections until it engages the inwardly directed peripheral flange on the access opening which serves as internal stop means, thereby serving as a ground level closure for the access opening when the telescopic pole assembly is in the telescopically extended position, the second access opening cover having a maintenance access hatch;

the telescopic pole assembly is moved from the retracted position to the telescopically extended position by several cable linkages including a drive cable linkage having a first end connected to a winch and a second end to a bottom end of a first of the several intermediate sections, such that upon the drive cable linkage being drawn in by the winch, the first intermediate section is telescopically extended from the base section, a first coupling cable linkage having a first end anchored to a bottom of the base section, a second end anchored to a bottom of a second of the several intermediate sections, the first coupling cable linkage passing over a first sheave positioned at an upper end of the first intermediate section, such that as the first intermediate section is telescopically extended to move the first sheave away from the base section where the first end of the first coupling cable linkage is anchored, the second intermediate section is drawn to the telescopically extended position, a second coupling cable linkage having a first end anchored to a bottom of the first intermediate section, a second end anchored to a bottom of the lamp support section, the second coupling cable linkage passing over a second sheave positioned at an upper end of the second intermediate section, such that as the second intermediate section is telescopically extended to move the second sheave away from the first intermediate section where the first end of the second coupling cable linkage is anchored, the lamp supporting section is drawn to the telescopically extended position; and a sump pump disposed within the upper portion of the shaft for ground water control.

5. A method of illuminating a golf course comprising the following steps:

firstly, excavating a plurality of shafts in a ground surface of a golf course, each shaft having a ground level access opening;

secondly, positioning a plurality of telescopically connected tubular sections forming a telescopic pole assembly into each of the excavated shafts, each telescopic pole assembly including a base section at a first end of the telescopic pole assembly, a lamp support section at a second end of the telescopic pole assembly and at least one intermediate section disposed between the base section and the lamp support section, the telescopic pole assembly being movable between a telescopically extended position and a retracted position, the base section being anchored within the shaft, the entire telescopic pole assembly being concealed within the shaft when in the retracted position, the at least one intermediate section and the lamp support section rising out of the shaft when in the telescopically extended position, a light fixture being mounted on the lamp support section;

a first access opening cover being mounted to a remote end of the lamp support section above the light fixture, such that the first access opening cover serves as a ground level closure for the access opening when the telescopic pole assembly is in the retracted position;

a second access opening cover being mounted to the at least one intermediate section, and internal stop means are provided around a periphery of the access opening, such that the second access opening cover is raised by the at least one intermediate section to engage the internal stop means, thereby serving as a ground level closure for the access opening when the telescopic pole assembly is in the telescopically extended position;

thirdly, maintaining the telescopic pole assembly in the retracted position during daylight hours and moving the telescopic pole assembly to the telescopically extended position to illuminate the golf course at night, and one shaft being positioned in the vicinity of a tee box for a golf hole so that the tee box is illuminated when the telescopic pole assembly is in the telescopically extended position, one shaft being positioned in the vicinity of a green for the golf hole so that the green is illuminated when the telescopic pole assembly is in the telescopically extended position, and at least one shaft being positioned along a fairway for the golf hole so that the fairway is illuminated when the telescope pole assembly is in the telescopically extended position.

* * * * *